US010770804B2

(12) United States Patent
Nomura et al.

(10) Patent No.: US 10,770,804 B2
(45) Date of Patent: Sep. 8, 2020

(54) WIRE WITH TERMINAL AND METHOD FOR PRODUCING WIRE WITH TERMINAL

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Hideki Nomura, Mie (JP); Hiroki Hirai, Mie (JP); Takuji Ootsuka, Mie (JP); Kohei Kobayashi, Mie (JP); Yoshiaki Yamano, Mie (JP); Takaaki Ito, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 16/479,977

(22) PCT Filed: Jan. 23, 2018

(86) PCT No.: PCT/JP2018/001867
§ 371 (c)(1),
(2) Date: Jul. 23, 2019

(87) PCT Pub. No.: WO2018/139420
PCT Pub. Date: Aug. 2, 2018

(65) Prior Publication Data

US 2019/0379144 A1 Dec. 12, 2019

(30) Foreign Application Priority Data

Jan. 24, 2017 (JP) ..... 2017-010061

(51) Int. Cl.
*H01R 4/18* (2006.01)
*H01R 4/70* (2006.01)
(Continued)

(52) U.S. Cl.
CPC ..... *H01R 4/185* (2013.01); *H01R 4/70* (2013.01); *H01R 43/005* (2013.01); *H01R 43/048* (2013.01)

(58) Field of Classification Search
None
See application file for complete search history.

(56) References Cited

U.S. PATENT DOCUMENTS

2008/0283268 A1* 11/2008 Iwasaki ..... H01B 7/285 174/78
2013/0040511 A1 2/2013 Takashima et al.
(Continued)

FOREIGN PATENT DOCUMENTS

JP 2010-108829 5/2010
JP 2011-018489 1/2011
(Continued)

OTHER PUBLICATIONS

International Search Report dated Mar. 27, 2018.

*Primary Examiner* — Oscar C Jimenez
(74) *Attorney, Agent, or Firm* — Gerald E. Hespos; Michael J. Porco; Matthew T. Hespos

(57) ABSTRACT

A wire with terminal 10 includes a wire 11 having a conductor part 12 and an insulation coating 13 surrounding the conductor part 12, a water stop portion 40 to be held in close contact with an outer surface of the insulation coating 13, and a terminal 20 having a conductor crimping portion 24 to be crimped to the conductor part 12 and a water stop
(Continued)

holding portion 27 configured to hold the water stop portion 40 by being held in close contact with an outer surface side of the water stop portion 40.

7 Claims, 10 Drawing Sheets

(51) Int. Cl.
*H01R 43/00* (2006.01)
*H01R 43/048* (2006.01)

(56) References Cited

U.S. PATENT DOCUMENTS

| | | | | |
|---|---|---|---|---|
| 2013/0213709 | A1* | 8/2013 | Kawamura | H01R 4/183 174/72 A |
| 2015/0140857 | A1 | 5/2015 | Sato et al. | |
| 2015/0140874 | A1 | 5/2015 | Sakaguchi | |
| 2015/0287496 | A1* | 10/2015 | Sato | H01R 4/70 174/74 R |
| 2016/0308301 | A1* | 10/2016 | Mano | H01R 13/5216 |
| 2017/0243673 | A1* | 8/2017 | Nakashima | C09D 151/08 |
| 2017/0338005 | A1* | 11/2017 | Ito | G06F 12/1009 |

FOREIGN PATENT DOCUMENTS

| | | |
|---|---|---|
| JP | 2013-125738 | 6/2013 |
| JP | 2014-029794 | 2/2014 |
| JP | 2015-201403 | 11/2015 |
| JP | 2016-167349 | 9/2016 |
| WO | 2011/096527 | 6/2013 |
| WO | 2014/021279 | 2/2014 |

* cited by examiner

WIRE WITH TERMINAL AND METHOD FOR PRODUCING WIRE WITH TERMINAL

BACKGROUND

Field of the Invention

A wire with terminal is disclosed in this specification.

Related Art

Japanese Unexamined Patent Publication No. 2011-18489 discloses a terminal with a first crimping portion to be crimped to an insulation coating of a wire and a second crimping portion to be crimped to a conductor of the wire. The first and second crimping portions are crimped simultaneously after a resin material is applied to the conductor of the terminal or the wire. The resin material applied to the conductor or the terminal is pressed at the time of crimping, and the conductor and an exposed part of the second crimping portion are covered by the resin material.

The first crimping portion is crimped to an exposed surface of an insulation coating in the configuration of Japanese Unexamined Patent Publication No. 2011-18489. Thus, the first crimping portion and the insulation coating are in contact. A clearance may be formed between the first crimping portion and the insulation coating due to vibration of a vehicle, aged deterioration or the like, and water attached to the wire from outside may move toward an end of the wire through this clearance to cause electrolytic corrosion in a part where the conductor of the wire and the terminal are in contact.

The invention was completed on the basis of the above situation and aims to prevent the intrusion of water into a part where a conductor of a wire and a terminal are connected.

SUMMARY

A wire with terminal disclosed in this specification includes a wire and a terminal. The wire has a conductor and an insulation coating surrounding the conductor. A water stop is to be held in close contact with an outer surface of the insulation coating. The terminal has a conductor crimping portion to be crimped to the conductor and a water stop holding portion configured to hold the water stop by being held in close contact with an outer surface of the water stop.

A method for producing the above-described wire with terminal includes a conductor part crimping step of crimping the conductor crimping portion to the conductor, a water stop forming step of forming the water stop by holding a resin in close contact with the insulation coating after the conductor crimping step, and a water stop holding step of holding the water stop from an outer surface by the water stop holding portion after the water stop forming step.

According to these configurations, the water stop prevents formation of a clearance between the insulation coating of the wire and the water stop holding portion, thereby preventing intrusion of water into a part where the conductor of the wire and the terminal are connected.

The water stop holding portion may include a bottom plate on which the wire is placed, and two barrel pieces may rise from the bottom plate. The water stop may be disposed between the bottom plate and the insulation coating. According to this configuration, the water stop prevents intrusion of water passing between the bottom plate and the insulation coating.

The water stop may be held in close contact with an entire outer periphery of the insulation coating, and the water stop holding portion may be held in close contact with an entire outer periphery of the water stop.

The water stop may be made of resin, and a viscosity of the resin before curing may be 1000 to 10000 mPa·s. According to this configuration, balance between the permeability of a water stopping agent into a clearance between conductors and stable retention of the resin at a desired position during application is excellent and waterproof performance and workability can be combined.

The resin may be a photocurable resin. According to this configuration, if the barrel pieces are set in an open state when the resin is cured, irradiated light is not blocked by the barrel pieces. Therefore the curing of the water stop between the bottom plate and the insulation coating can be promoted.

The water stop holding portion may include a bottom plate on which the wire is placed, and two barrel pieces rising from the bottom plate. The resin may be a photocurable resin, and the resin may be cured by having light irradiated thereto in the water stop forming step.

According to this specification, it is possible to suppress the intrusion of water into a part where a conductor of a wire and a terminal are connected.

DETAILED DESCRIPTION

An embodiment is described with reference to FIGS. 1 to 10. A wire with terminal 10 of this embodiment can constitute a power supply path, for example, by being mounted in a vehicle such as an automotive vehicle.

(Wire with Terminal 10)

Figure 8:
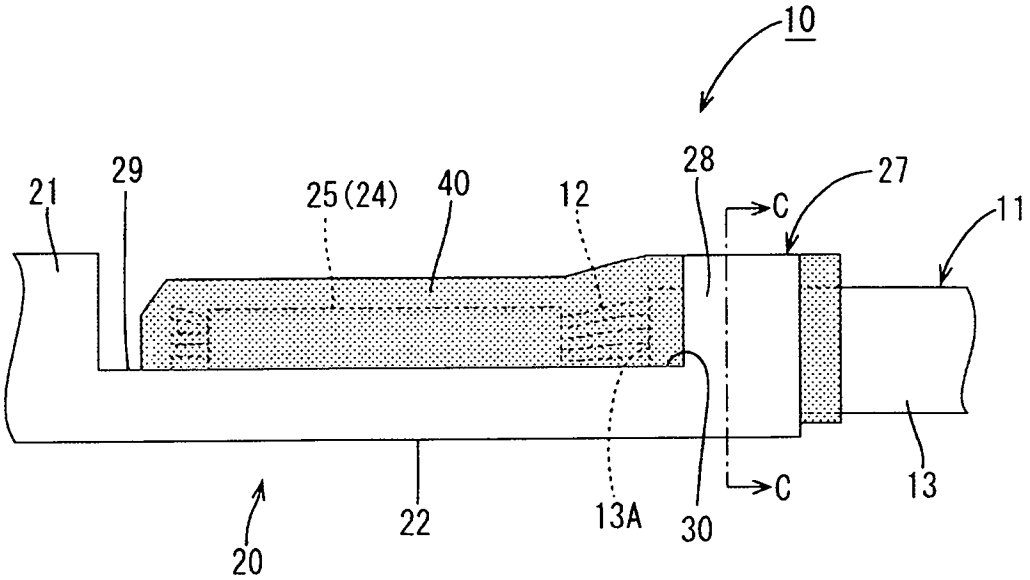
FIG. 8 is a side view showing the wire with terminal.

As shown in FIG. 8, the wire with terminal 10 includes a wire 11, a terminal 20 mounted on an end of the wire 11, and a water stop 40 for restricting intrusion of water into a part where the wire 11 and the terminal 20 are connected.

(Wire 11)

Figure 1:
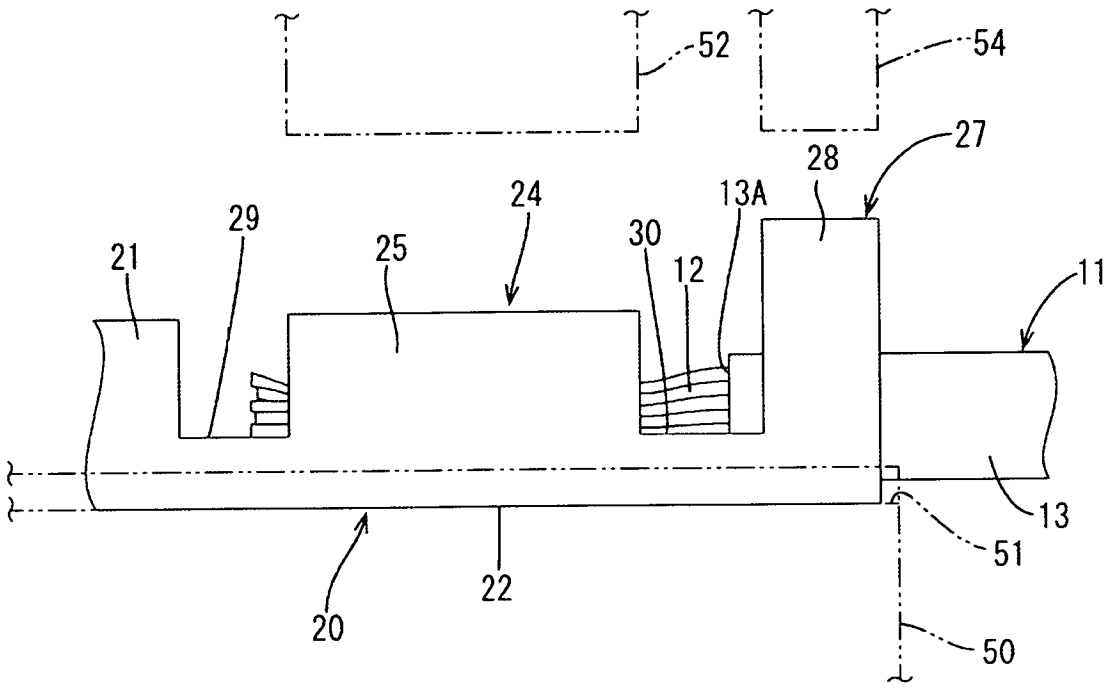
FIG. 1 is a side view showing a state where a conductor of a wire is placed on a terminal in an embodiment.

As shown in FIG. 1, the wire 11 is a coated wire including a conductor 12 and an insulation coating 13 (insulation layer) made of synthetic resin and surrounding the outer periphery of the conductor 12. A material constituting the conductor 12 is aluminum or aluminum alloy in this embodiment. Note that the material constituting the conductor 12 is not limited to this, and copper, copper alloy, or other material can be selected according to need. The insulation coating 13 is removed on an end part of the wire 11, and the conductor 12 is exposed in front of (left side in FIG. 1) a tip 13A of the insulation coating 13. Note that although the conductor part 12 is a twisted wire formed by twisting a plurality of metal strands in this embodiment, there is no limitation to this and a single-core wire made of one conductor may be used.

(Terminal 20)

The terminal 20 is, for example, a female terminal and includes a terminal connecting portion 21 to be connected to a mating terminal, a bottom plate 22 on which the conductor 12 of the wire 11 is placed, a conductor crimping portion 24 to be crimped to the conductor 12, and a water stop holding portion 27 to be crimped to hold the water stop 40 covering the insulation coating 13 from the outside of the water stop 40. The terminal connecting portion 21 is box-shaped and a resilient contact piece (not shown) configured to resiliently contact a mating male terminal (not shown) is resiliently deformably provided inside.

The conductor crimping portion 24 includes two wire barrel pieces 25 rising from left and right sides of the bottom plate 22. The wire barrel pieces 25 are crimped by a mold including an anvil 50 (lower mold) and a crimper 52 (upper mold), arcuately deformed inwardly by being contacted by the lowered crimper 52, and connected to the conductor 12 to bite into the conductor 12. The water stop holding portion 27 is provided behind and at a distance from the conductor crimping portion 24 and includes two barrel pieces 28 rising from the left and right sides of the bottom plate 22. The barrel pieces 28 are crimped by a mold including the anvil 50 and a crimper 54 (upper mold) after the wire barrel pieces 25 are crimped, and arcuately deformed inwardly by being contacted by the lowered crimper 54. Thus, an upper surface 22A of the bottom plate 22 and the inner surfaces of the wire barrel pieces 25 are held in close contact with the entire outer periphery of the water stop 40. Cutouts 29, 30 are formed before and behind the conductor crimping portion 24 above the bottom plate 22. One cutout 29 divides between the terminal connecting portion 21 and the conductor crimping portion 24 and the other cutout 30 divides between the conductor crimping portion 24 and the water stop holding portion 27.

Figure 3:
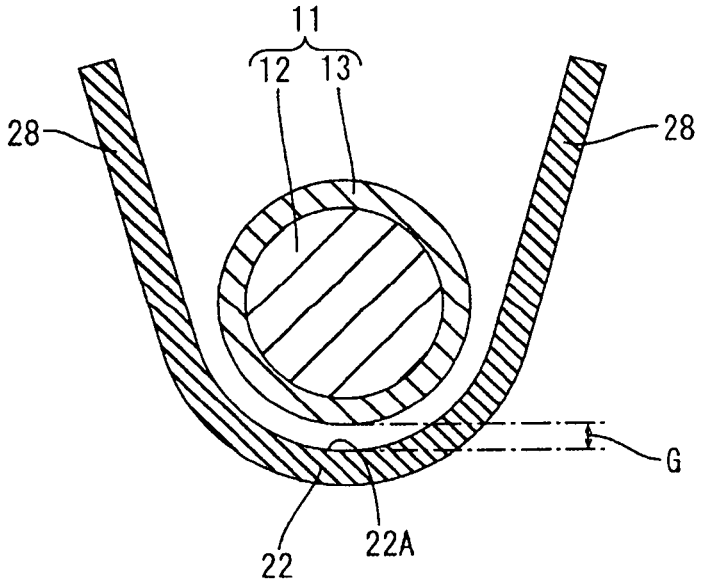
FIG. 3 is a section along A-A of FIG. 2.
Figure 4:
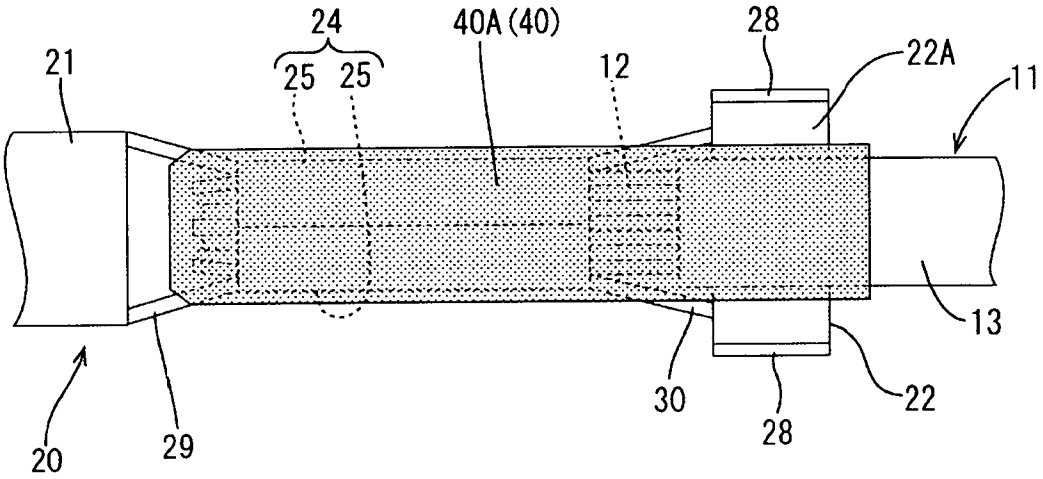
FIG. 4 is a plan view showing a state where an anticorrosive agent is applied from the state of FIG. 2.

The bottom plate 22 is connected behind a bottom plate of the terminal connecting portion 21 and has a cross-sectional shape arcuately curved along the outer periphery of the wire 11, as shown in FIG. 3. The upper surface 22A of the bottom plate 22 has an arcuate shape in conformity with the outer shape of the wire 11, is arranged to face the insulation coating 13 while being spaced apart by a clearance G (interval), and is in contact with the conductor 12 in front of the insulation coating 13.

A metal material constituting the terminal 20 is copper or copper alloy in this embodiment. Note that the metal material constituting the terminal 20 is not limited to this and may be aluminum, aluminum alloy or the like. A metal material can be selected according to need, but the use of a material that easily is corroded electrolytically with the conductor part 12 is an option since electrolytic corrosion can be suppressed by the water stop 40 of this embodiment. This terminal 20 is formed by stamping a metal plate material into a development shape of the terminal 20 and applying bending. Note that plating layers (not shown) may be formed on surfaces of this embodiment. Examples of a metal constituting the plating layers include tin, nickel and the like and an appropriate metal material is selected according to need.

(Water Stop 40)

Figure 6:
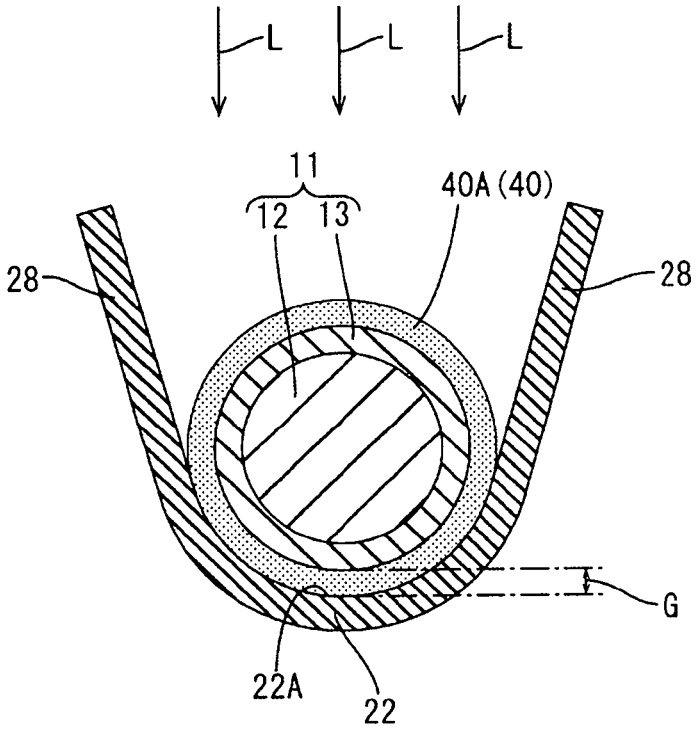
FIG. 6 is a section along B-B of FIG. 5.
Figure 7:
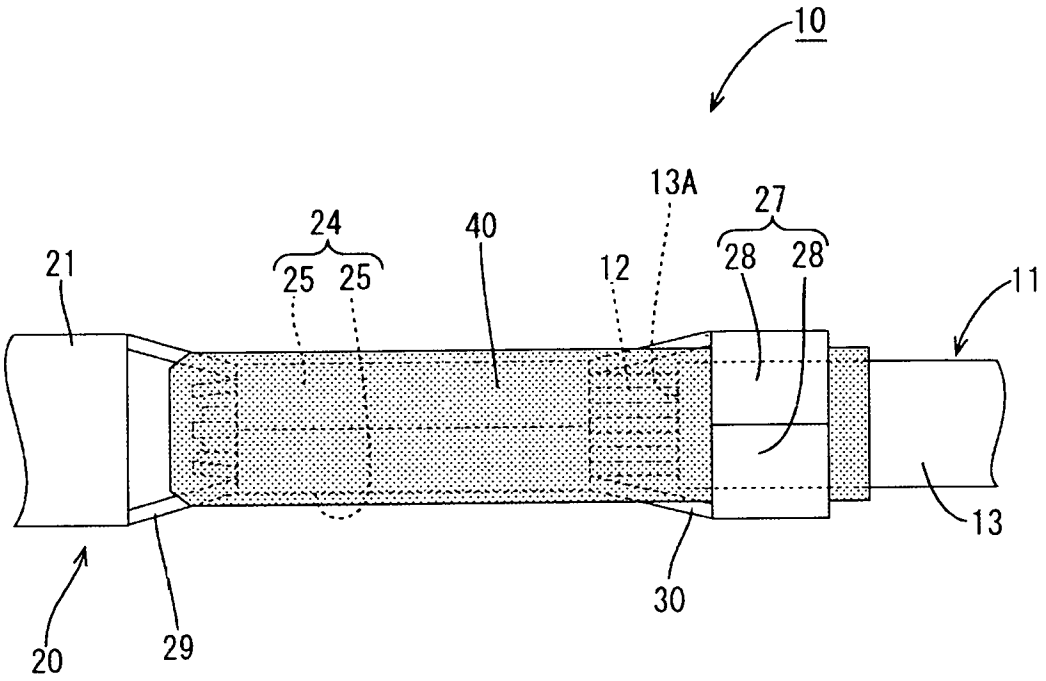
FIG. 7 is a plan view showing a wire with terminal.

As shown in FIG. 6, the water stop 40 can be formed by curing an anticorrosive agent 40A made of synthetic resin and attached to the wire 11 and the terminal 20. A material of the anticorrosive agent 40A can be selected, for example, from a urethane UV acrylate resin, an olefin resin, a polyamide resin, a polyester resin, an acrylic resin, an epoxy resin, a silicone resin, a urethane resin, a phenol resin and the like, but the urethane UV acrylate resin (an example of a "photocurable resin") that is cured by the irradiation of ultraviolet rays (an example of "light") is more preferable. Further, a resin that is cured by heat may be used. One or more types of photoinitiators that start a reaction by the irradiation of ultraviolet rays and peroxides that start a reaction by heat may be added. The anticorrosive agent 40A may have one of various viscosities. For example, the viscosity of the anticorrosive agent 40A can be set at 1000 to 10000 mPa·s. The water stop 40 after curing is preferably resiliently deformable to such an extent that the water stop 40 is not damaged when the barrel pieces 28 are crimped to the water stop 40.

A method for producing the wire with terminal 10 is described.

(Conductor Part Crimping Step)

Figure 2:
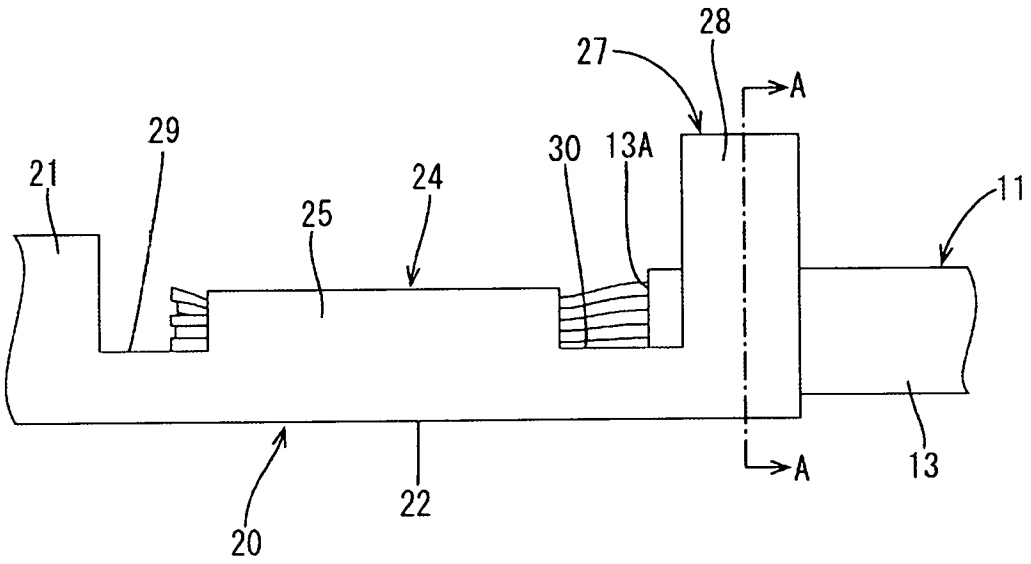
FIG. 2 is a side view showing a state where a conductor crimping portion of the terminal is crimped to a conductor part.

As shown in FIG. 1, the insulation coating 13 on the end part of the wire 11 is removed to expose the conductor 12, and the conductor 12 is placed at a predetermined position on the bottom plate 22 of the terminal 20 placed on the anvil 50. At this time, the clearance G is formed between the upper surface 22A of the bottom plate 22 and the insulation coating 13 of the wire 11 (see FIG. 3), and the bottom plate 22 and the insulation coating 13 are not in contact. Subsequently, when the crimper 52 (upper mold) is lowered, the wire barrel pieces 25 are deformed by being contacted by the crimper 52, and crimped to the conductor 12 (FIG. 2). Note that although the clearance G is formed between the bottom plate 22 and the insulation coating 13 when the conductor part 12 is crimped, there is no limitation to this. For example, the upper surface 22A of the bottom plate 22 and the insulation coating 13 may be held in contact when the conductor part 12 is crimped, and the upper surface 22A of the bottom plate 22 and the insulation coating 13 may be separated to form the clearance G after the conductor 12 is crimped.

(Water Stop Portion Forming Step)

Figure 5:
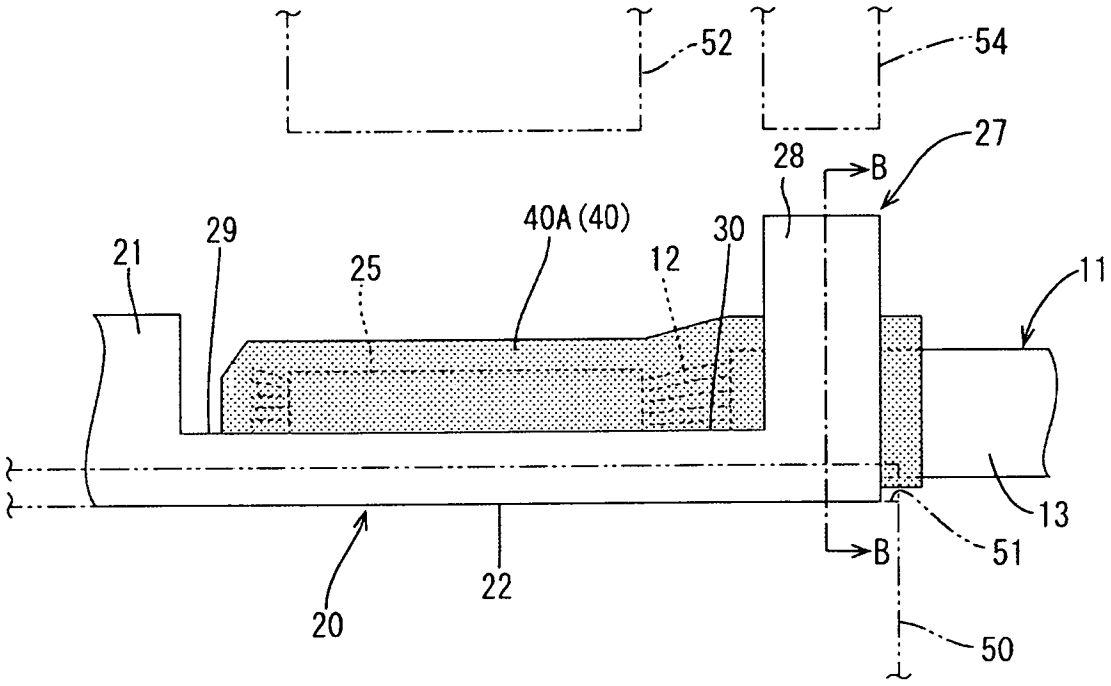
FIG. 5 is a side view showing the state where the anticorrosive agent is applied from the state of FIG. 2.

Subsequently, an ultraviolet curable urethane UV acrylate resin is, for example, applied as the anticorrosive agent 40A to an area of the insulation coating 13 at a position corresponding to the exposed conductor part 12 of the wire 11, the conductor crimping portion 24 of the terminal 20, the upper surface 22A of the bottom plate 22 and the barrel pieces 28, as shown in FIG. 5, and ultraviolet rays are irradiated from above, as shown in FIG. 6. At this time, the barrel pieces 28 are not crimped and are in an open state. Thus, the ultraviolet rays are irradiated to an upper surface side of the anticorrosive agent 40A without being blocked by the barrel pieces 28. As the upper surface side of the anticorrosive agent 40A is cured by the ultraviolet rays, the anticorrosive agent 40 on a lower side is cured by a chain reaction (radical reaction). When the anticorrosive agent 40A between the bottom plate 22 and the insulation coating 13 is cured, the entire anticorrosive agent 40A is cured to form the water stop 40.

(Water Stop Portion Holding Step)

Figure 9:
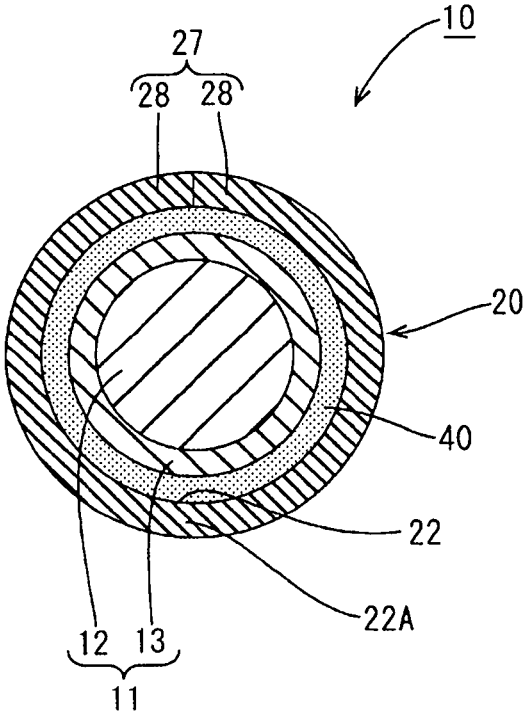
FIG. 9 is a section along C-C of FIG. 8.

Subsequently, when the crimper 54 is lowered with the bottom plate 22 of the terminal 20 placed on the anvil 50, the barrel pieces 28 are deformed by being contacted by the crimper 54. When the tips of the barrel pieces 28 come into contact with each other, the barrel pieces 28 are crimped to the water stop 40 (and the wire 11 including the insulation coating 13) from outside to form the annular water stop holding portion 27 (FIG. 9). At this time, the water stop holding portion 27 is held in close contact with the outer surface of the water stop 40 and holds the water stop 40 (and the wire 11 including the insulation coating 13) from the outer surface side of the water stop 40.

According to this embodiment, the following functions and effects are achieved.

The wire with terminal 10 includes the wire 11 having the conductor part 12 and the insulation coating 13 surrounding the conductor part 12, the water stop 40 to be held in close contact with the outer surface of the insulation coating 13, and the terminal 20 having the conductor crimping portion 24 to be crimped to the conductor part 12 and the water stop holding portion 27 configured to hold the water stop 40 by being held in close contact with the outer surface side of the water stop 40.

Figure 10:
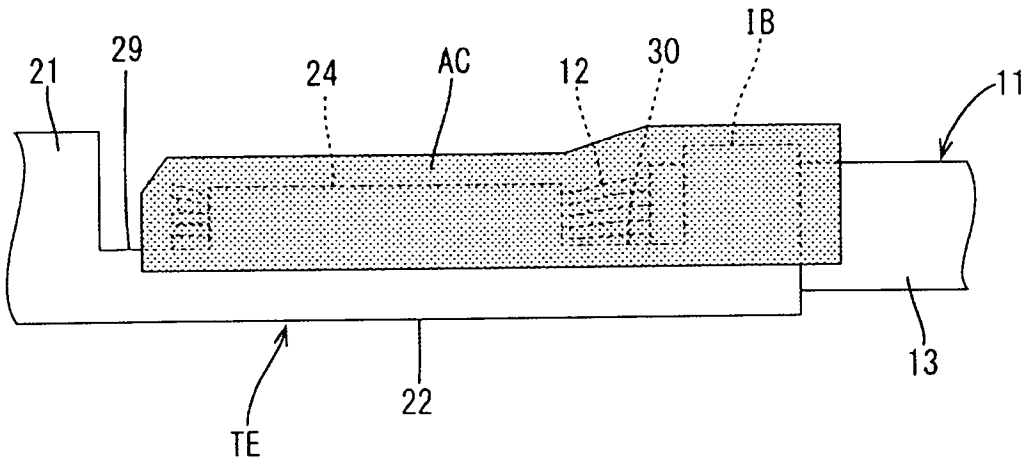
FIG. 10 is a side view showing a wire with terminal as a comparative example.

For example, if a water stop portion AC is formed by applying an anticorrosive agent after a conductor crimping portion 24 is crimped to the conductor part 12 and an insulation barrel IB of a terminal TE is crimped to the insulation coating 13, for example, as shown in FIG. 10 as a comparative example, the insulation barrel IB is directly in contact with the insulation coating 13 (without the water stop portion). Thus, clearances are easily formed between the insulation barrel IB and the insulation coating 13 and between a bottom plate 22 and the insulation coating 13 due to the vibration of a vehicle, aged deterioration or the like. If water adhering to the wire 11 intrudes into connecting parts of the wire 11 and the terminal TE through this clearance, electrolytic corrosion may take place. According to this embodiment, since the clearance G through which water passes is not easily formed between the insulation coating 13 of the wire 11 and the water stop holding portion 27 due to the water stop 40, the intrusion of water into a part where the conductor part 12 of the wire 11 and the terminal 20 are connected is suppressed.

Further, a cross-sectional area of the wire with terminal can be reduced as compared to a configuration in which the water stop 40 is disposed, for example, on the outer surface side of the water stop holding portion 27 by being between the insulation coating 13 of the wire 11 and the water stop holding portion 27, the wire with terminal 10 can be, for example, easily inserted into a cavity of a connector.

Further, the water stop holding portion 27 includes the bottom plate 22 on which the wire 11 is placed and the two barrel pieces 28 rising from the bottom plate 22, and the water stop 40 is between the bottom plate 22 and the insulation coating 13. According to this configuration, the intrusion of water passing between the bottom plate 22 and the insulation coating 13 can be suppressed by the water stop 40.

Further, the water stop 40 is made of resin and the viscosity of the resin before curing is 1000 to 10000 mPa·s. According to this configuration, balance between the permeability of a water stopping agent into a clearance or the like between conductors and stable retention of the resin at a desired position during application is excellent and waterproof performance and workability can be combined.

Further, the water stop 40 is made of the photocurable resin that is cured by the ultraviolet rays L (light). According to this configuration, if the barrel pieces 28 are set in the open state when the resin is cured, the irradiated light is not blocked by the barrel pieces 28. Therefore the curing of the water stop 40 between the bottom plate 22 and the insulation coating 13 can be promoted.

The invention is not limited to the above described and illustrated embodiment. For example, the following embodiments also are included in the scope of the invention disclosed in this specification.

Although the water stop 40 is held in close contact with the entire outer periphery of the insulation coating 13 and the water stop holding portion 27 is held in close contact with the entire outer periphery of the water stop 40, there is no limitation to this. For example, the water stop 40 may be formed only between the bottom plate 22 and the insulation coating 13.

Although the tips of the barrel pieces 28 come into contact with each other, there is no limitation to this and the barrel pieces may partially overlap. Further, although the conductor crimping portion 24 and the water stop holding portion 27 are of an open barrel type including the two wire barrel pieces 25 or the barrel pieces 28, the conductor crimping portion 24 and the water stop holding portion 27 may be of an annular closed barrel type and barrel portions may be crimped with the conductor part 12 and the insulation coating 13 inserted in the annular barrel portions.

LIST OF REFERENCE SIGNS

10: wire with terminal
11: wire
12: conductor
13: insulation coating
20: terminal
22: bottom plate
24: conductor crimping portion
27: water stop holding portion
28: barrel piece
40: water stop
40A: anticorrosive agent
G: clearance

The invention claimed is:

1. A wire and terminal assembly, comprising:

a wire including a conductor extending to an end of the wire and an insulation coating surrounding the conductor at locations spaced from the end of the wire to define an exposed conductor portion adjacent to the end of the wire;

a water stop held in close contact with an outer surface of the insulation coating along an area of the insulation coating substantially adjacent the exposed conductor portion and the water stop extending around an outer circumference of the insulation coating; and a terminal including a conductor crimping portion crimped to the conductor and a water stop holding portion held in close contact with an outer surface side of an area of the water stop that is held in close contact with an outer surface of the insulation coating, the water stop holding portion including a bottom plate opposed to the wire and two barrel pieces rising from the bottom plate wherein the water stop is made of resin that is cured by light irradiation, and disposed between the bottom plate of the water stop holding portion and the insulation coating.

2. The wire and terminal assembly of claim 1, wherein the water stop holding portion is held in close contact with an entire outer periphery of the water stop.

3. The wire and terminal assembly of claim 1, wherein the water stop portion is made of resin, and a viscosity of the resin before curing is 1000 to 10000 mPa·s.

4. The wire and terminal assembly of claim 1, wherein the water stop further covers the exposed conductor portion and the conductor crimping portion.

5. A method for producing a wire and terminal assembly with a wire including a conductor extending to an end of the wire and an insulation coating surrounding the conductor at locations spaced from the end of the wire to define an exposed conductor portion adjacent to the end of the wire, and a terminal including a conductor crimping portion to be crimped to the exposed conductor and a water stop holding portion substantially adjacent the conductor crimping portion, the method comprising:

a conductor crimping step of crimping the conductor crimping portion to the exposed conductor portion;

a water stop forming step of applying a resin in close contact with the exposed conductor portion, the conductor crimping portion that has been crimped to the exposed conductor portion and all areas of the insulation coating aligned with the water stop holding portion; and a water stop holding step of holding the resin from an outer surface side by the crimping of the water stop holding portion to an outer surface of the resin.

6. The method of claim 5, wherein:

the resin is a photocurable resin; and the resin is cured by having light irradiated thereto in the water stop forming step.

7. The method of claim 6, further comprising leaving a clearance between the insulation coating of the wire and the water stop holding portion before the water stop forming step, and wherein the water stop forming step includes inserting the resin between the water stop holding portion and the insulation coating of the wire.

* * * * *